United States Patent [19]

Dunaway, Jr. et al.

[11] Patent Number: 4,817,482

[45] Date of Patent: Apr. 4, 1989

[54] WORKPIECE GUIDE FOR USE WITH TABLE SAWS

[76] Inventors: James T. Dunaway, Jr., 3690 Mack Rd., Unit 5, Fairfield, Ohio 45014; John T. Pater, 1171 Kahn Ave., Hamilton, Ohio 45011

[21] Appl. No.: 31,377

[22] Filed: Mar. 30, 1987

[51] Int. Cl.[4] ..... B27B 27/02

[52] U.S. Cl. ..... 83/438; 83/467 R; 83/477.2

[58] Field of Search ..... 83/438, 437, 448, 441.1, 83/442, 444, 467 R, 477.2, 478

[56] References Cited

U.S. PATENT DOCUMENTS

| | | | |
|---|---|---|---|
| 1,938,548 | 12/1933 | Tautz | 83/438 |
| 4,432,263 | 2/1984 | Kowalchuk | 83/438 |
| 4,558,618 | 12/1985 | Bachmann et al. | 83/438 |
| 4,593,590 | 6/1986 | Gray | 83/438 |
| 4,603,612 | 8/1986 | Atkins | 83/425 |

*Primary Examiner*—Frank T. Yost
*Assistant Examiner*—Hien H. Phan
*Attorney, Agent, or Firm*—Charles R. Wilson

[57] ABSTRACT

A workpiece guide is dimensioned to fit over a table saw fence. The guide is comprised of an elongated inverted U-shaped body with a first leg angled inwardly to aid in a snug fit with the fence. A second leg of the body has a horizontal lip at its lower extremity which rests flat against the table top saw surface during use. A guide strip extends along the second leg. A thin workpiece is held in a steady position during a cutting operation by passing the workpiece between the guide strip and lip. A stop on the workpiece is also provided to ensure the guide does not ride forward along the fence during the cutting operation.

17 Claims, 1 Drawing Sheet

WORKPIECE GUIDE FOR USE WITH TABLE SAWS

This invention relates to a workpiece guide for use with table saws. More particularly, the invention relates to a workpiece guide intended for use on a fence to aid in the cutting of thin workpieces.

BACKGROUND OF THE INVENTION

Power drive table saws with circular saw blades are widely used, both in the home and in industry. They are used for the cutting of rough lumber and the cutting of thin workpieces such as laminates, wood veneers, aluminum sheeting, etc. Quite often a fence is added to the top surface of the table saw to act as a guide in obtaining a straight cut of a desired width. Fences come in various designs and sized, though all have a straight bar portion that extends the length of the table top. They are positioned on the top surface of the table saw parallel to the plane of the saw blade and secured a desired distance therefrom. A workpiece is cut to the desired width by moving one edge along the fence during the cutting operation.

It has been found that a problem particularly unique with the cutting of thin workpieces is encountered with known fences. There is a small clearance between most fences and the table saw's top surface. Thin workpieces can readily slide underneath the fence to cause a wrong cut. Wood strips are often used next to the fence to block the thin clearance. However, this can affect any precision width cut originally gained from the fence. Additionally, rotary action of the saw blade tends to cause a shattering of thin workpieces while being cut.

There is a need for an article for use with conventional table saws which will allow the safe and efficient cutting of thin workpieces. Any such article must not interfere with the precision cutting offered by known fences, yet must be able to cut thin workpieces. Ideally, any device must be capable of ready attachment to existing table saws and removal therefrom when not needed. There now has been devised a workpiece guide which is well adapted for use with conventional table saws. The guide permits the precision cutting of thin workpieces without shattering.

SUMMARY OF THE INVENTION

A workpiece guide for use on a table saw is dimensioned to fit over a fence commonly used with such saws. The guide is especially useful in cutting of thin workpieces such as laminates. The workpiece guide has an elongated inverted U-shaped body which straddles the fence. A first leg of the body is angled inwardly so as to exert a holding force against the fence. A second leg of the U-shaped body is long enough so that when the body is positioned on the fence, a lip extending horizontally from the second leg will rest upon the table saw's top surface. A guide strip extends along the length of the U-shaped body a short distance from the lip. Any workpiece to be cut is fed along the table top using the guide strip to ensure the workpiece is held steady during the cutting operation.

DETAILED DESCRIPTION OF THE INVENTION

Figure 1:
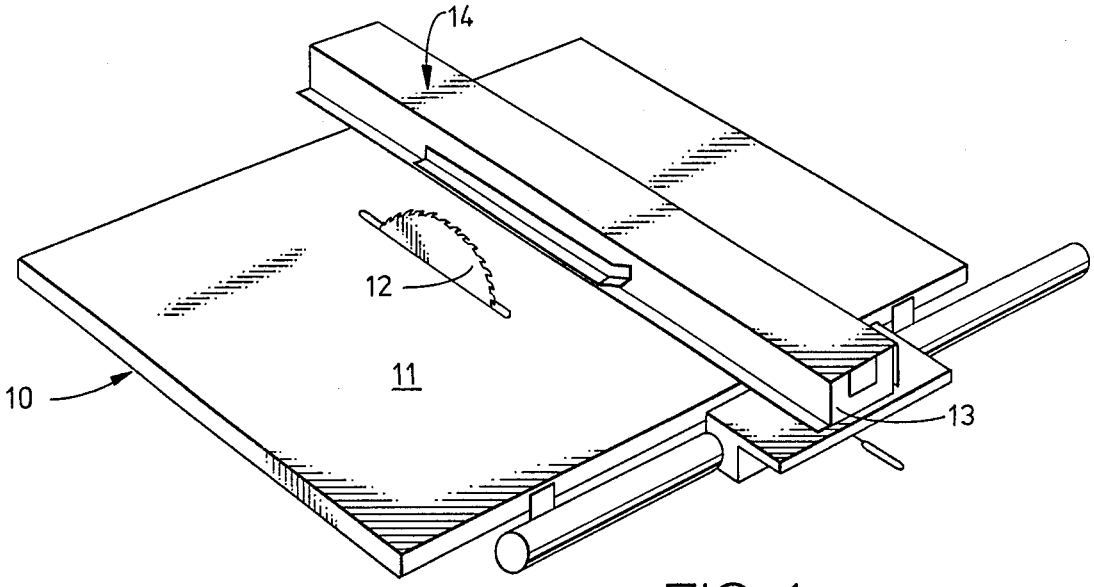
FIG. 1 is a perspective view of the workpiece guide of this invention when positioned on a table saw fence.

With reference to FIG. 1 there is shown a typical power driven table saw 10 with table top surface 11 and circular saw blade 12 extending through the table top surface. A fence 13 is positioned on the table saw. There are several different styles of fences commercially available. However, they all have a horizontal crossbar intended to sit directly above the table top. Various attachments of different types are found normally on or near each end of the fence for moving the fence along the table top a prescribed distance. The workpiece guide of this invention, shown generally as 14, is adapted for use with all known fences of the type described.

Figure 2:
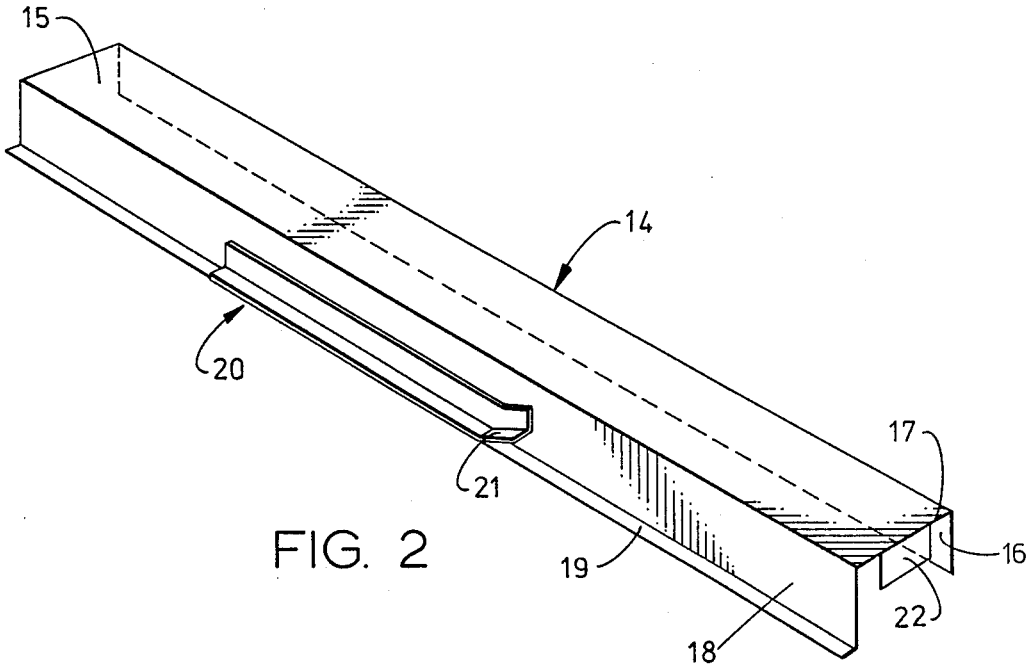
FIG. 2 is a side view of the workpiece guide of FIG. 1.
Figure 3:
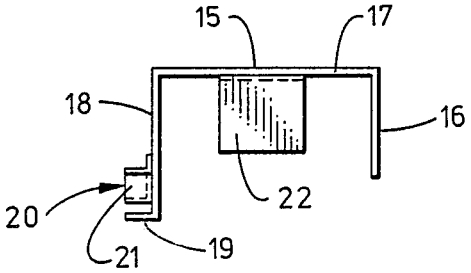
FIG. 3 is an end view of the workpiece guide of FIG. 1 showing a stop positioned on one end of the guide.

As shown in FIGS. 2 and 3, the workpiece guide comprises an elongated inverted U-shaped body 15. The body's length is sufficient to extend from one end of the fence to at least the back edge the circular saw. Preferably, the workpiece guide extends substantially the entire length of the fence. Leg 16 of the body is angled inwardly so that when properly positioned on the fence a snug fit will result. An angle of from about one degree to about fifteen degrees inwardly from the vertical, preferably from about five degrees to about ten degrees inwardly from the vertical is used to accomplish the above stated purpose. The width of bridge 17 is such that it overlaps the width of the fence on which it rests. Preferably, the width of the bridge ranges from about one-sixteenth inch to about one-fourth inch greater than that of the fence.

Second leg 18 extends from bridge 17 at substantially a right angle a sufficient distance so that when the workpiece guide straddles the fence, the bottom edge of leg 18 touches table top surface 11. Lip 19 extends horizontally from the bottom edge of leg 18. The purpose of lip 19 is to ensure that a thin workpiece being fed along the fence will not slip underneath the fence thereby resulting in an improperly cut workpiece.

A guide strip 20 is secured by spot welding on the second leg 18 and extends along the length of the leg so as to be substantially parallel with the lip. A feed end 21 of the guide strip is angled upwardly to aid in the feeding of a thin workpiece. Any upward inclination of feed end 21 helps, though optimium results are obtained when the feed end is angled upwardly at between about twenty-five degrees to about thirty-five degrees from the horizontal. The guide strip can extend substantially the entire length of the body 15. It is preferred that the guide strip be positioned in the mid-point of the body so as to be centered with the saw-blade and have an about one to two inch overlap on each side of the blade. Positioning the feed end of guide strip 20 inwardly from one end is prefered because often a large sheet of thin workpiece must first be supported by a part of the table top surface and then fed into feed end 21. Additionally, it is easier to see that the workpiece is being properly guided when the feed end is close to the circular saw blade. Guide strip 20 and lip 19 each extend outwardly from the leg 18 about one-half inch to about one inch. Greater distances than about one inch are possible, though provide no benefit and are generally avoided.

The vertical distance between lip 19 and guide strip 20 is dictated by the thickness of the workpiece to be cut. The workpiece guide of this invention is most advantageously used with thin workpieces of about one-eighth inch or less. Such workpieces comprise laminates, wood veneers, plastic sheets such as Plexiglass, aluminum sheets and the like. The guide is most useful with the cutting of laminates. Accordingly, the distance between the lip and the guide strip ranges from about one-eighth inches to about three-sixteenth inches. This relatively small distance ensures that the thin workpieces will be held steady during a cutting operation, thereby substantially reducing any tendency for the workpiece to chip, shatter or ride up on the saw blade.

Figure 4:
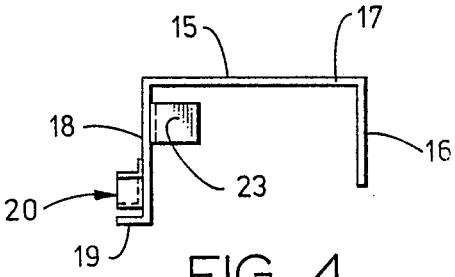
FIG. 4 is an end view of a workpiece guide showing a stop positioned on one end of a leg.

A stop is used in association with inverted U-shaped body 15 to prevent the workpiece guide from sliding along the fence during a cutting operation. Movement of the thin workpiece along the guide strip will have a natural inclination to cause the workpiece guide to move in the same direction. As shown in FIG. 3, a stop 22 is attached to the end of body 15 so as to engage the end of the fence. Stop 22 is a bracket which extends at an about ninety degree angle down from bridge 17, though it could extend inwardly from second leg 18 as well. Thus, as shown in FIG. 4, a stop 23 is attached to second leg 18 at an about 90 degree angle.

In operation, the workpiece guide is first positioned over the fence of the table saw. The guide is pushed down until the lip of the second leg is flat with the tables saw's top surface. It is then slid along the fence until the stop engages the fence and prevents further lateral movement. In this position, the first leg is pressing against a back side of the fence, thereby exerting a holding force. Next, a thin workpiece is placed on the table top surface and aligned with the side of the guide. The workpiece is finally cut to a desired width by feeding it along the guide, into the feed end and further along the guide while held firmly by the guide strip and lip. When the cutting operation has ended, the workpiece guide is simply lifted off the fence and stored.

The workpiece guide of this invention has been described with particular reference to the drawings. Various attachments such as wood strips positioned in the interior portion of the U-shaped body to accomodate various sized fences can be added. Other obvious embodiments such as stops of various designs are contemplated herein as being within the scope of the appended claims.

What is claimed is:

1. A workpiece guide for use on a table saw fence as an aid in the cutting of thin workpieces, said guide comprising:

(a) an elongated inverted U-shaped body dimensioned to straddle the fence with a first leg of the body angled inwardly so as to exert a holding force on the fence, a bridge extending from the first leg, a second extending from the bridge to a top surface of the table saw with a lip extending outwardly from a bottom extremity of the second leg;

(b) a guide strip extending along the length of the U-shaped body and immovably secured thereto, said guide strip positioned above the lip and substantially parallel with the lip so that a thin workpiece will slide between said guide strip and lip in a steady fashion, further wherein the guide strip is angled upwardly at a workpiece feed side as an aid to feeding the thin workpiece along the guide and into a saw blade; and (c) a stop in association with the U-shaped body to engage said fence and prevent lateral movement of the workpiece guide along the fence during a cutting operation.

2. The workpiece guide of claim 1 wherein the stop is a bracket attached at an about 90 degree angle to a back edge of the bridge.

3. The workpiece guide of claim 2 wherein the stop extends downwardly from the bridge.

4. The workpiece guide of claim 3 wherein the guide strip is positioned on the U-shaped body at mid-point so as to be centered with a saw blade on the table saw and have an overlap on each side of the blade of from about one inch to about two inches.

5. The workpiece guide of claim 1 wherein the lip and guide strip extend outwardly from the second leg from about one-half inch to about one inch.

6. The workpiece guide of claim 5 wherein the vertical distance between the lip and the guide strip ranges from about one-eighth inches to about three-sixteenth inches.

7. The workpiece guide of claim 6 wherein the first leg is angled inwardly from the vertical between about one degree to about fifteen degrees.

8. The workpiece guide of claim 7 wherein the first leg is angled inwardly from the vertical between about five degrees to about ten degrees.

9. The workpiece one end of the guide of claim 1 wherein the guide strip is angled upwardly about twenty-five degrees to about thirty-five degrees from the horizontal.

10. The workpiece guide of claim 1 wherein the guide strip extends along the U-shaped body from a point which is centered with the saw blade with an about 1 inch to about 2 inch overlap to substantially the entire length of the U-shaped body.

11. The workpiece guide of claim 1 wherein the stop is a bracket attached at an about 90 degree angle to a back edge of the second leg.

12. A workpiece guide for use on a table saw fence as an aid in the cutting of thin workpieces, said guide comprising:

(a) an elongated inverted U-shaped body dimensioned to straddle the fence with a first leg of the body angled inwardly so as to exert a holding force on the fence, a bridge extending from the first leg, a second leg extending from the bridge to a top surface of the table saw with a lip extending outwardly from a bottom extremity of the second leg;

(b) a guide strip extending along the length of the U-shaped body above the lip and positioned at mid-point so as to be centered with a saw blade on the table saw and having an overlap on each side of the blade of from about one inch to about two inches so that a thin workpiece will slide between said guide strip and said lip in a steady fashion, further wherein the guide strip is angled upwardly at a workpiece side as an aid to feeding the thin workpiece along the guide and into a saw blade; and (c) a stop in association with the U-shaped body to engage said fence and prevent lateral movement of the workpiece guide along the fence during a cutting operation.

13. The workpiece guide of claim 12 wherein the stop is a bracket attached at an about 90 degree angle to a back edge of the bridge.

14. The workpiece guide of claim 12 wherein the stop is a bracket attached at an about 90 degree angle to a back edge of the second leg.

15. The workpiece guide of claim 12 wherein the lip and the guide strip extend outwardly from the second leg from about one-half inch to about one inch.

16. The workpiece guide of claim 15 wherein the vertical distance between the lip and the guide strip ranges from about one-eight inches to about three-sixteenth inches.

17. The workpiece guide of claim 16 wherein the first leg is angled inwardly from the vertical between about one degree to about fifteen degrees.

* * * * *